US006772807B1

(12) United States Patent
Tang

(10) Patent No.: US 6,772,807 B1
(45) Date of Patent: Aug. 10, 2004

(54) SEALING STRUCTURE OF DRINKING WATER TANK

(76) Inventor: Chang Kuei Tang, No. 14, Lane 54, Lungchiuan St., Banchiau City, Taipei (TW), 220

( * ) Notice: Subject to any disclaimer, the term of this patent is extended or adjusted under 35 U.S.C. 154(b) by 0 days.

(21) Appl. No.: 10/460,236

(22) Filed: Jun. 13, 2003

(51) Int. Cl.[7] ..... B65B 1/04; B65B 3/00; B67C 3/00

(52) U.S. Cl. ..... 141/352; 141/18; 141/284; 141/325; 141/351; 141/353; 141/363; 141/364; 141/365; 141/366; 62/389

(58) Field of Search ..... 141/18, 284, 285, 141/291, 297–299, 311 R, 319, 351–353, 363–366; 62/389

(56) References Cited

U.S. PATENT DOCUMENTS 4,629,096 A 12/1986 Schroer et al.
5,413,152 A * 5/1995 Burrows ..... 141/18
5,493,873 A 2/1996 Donselman et al.
5,653,270 A * 8/1997 Burrows ..... 141/18
5,676,278 A 10/1997 Beyer et al.
6,123,232 A 9/2000 Donselman et al.
6,354,344 B1 3/2002 Pluta et al.

* cited by examiner

*Primary Examiner*—Timothy L. Maust

(57) ABSTRACT

A sealing structure of a drinking water tank. The water tank has a mouth covered with a cap. The cap has a hollow guide recessed from a center thereof, and a sealing cover receiving the hollow guide therein. The hollow guide defines an opening for water contained in the water tank to flow through, while the sealing cover has a bottom wall and sidewall extending perpendicularly from the bottom wall to seal the opening. The sidewall further has a first latching structure at the edge of the sidewall, such that the sealing cover is in friction contact with the hollow guide to provide a sealing effect. The hollow guide also has a second latching structure formed at an edge thereof to be latched with the first latching structure.

11 Claims, 9 Drawing Sheets

SEALING STRUCTURE OF DRINKING WATER TANK

BACKGROUND OF THE INVENTION

The present invention relates generally to a sealing structure of a drinking water tank and, more particularly, to a sealing cover that seals the drinking water tank with the cap, and engaged with the cap and a water inlet and venting pipe of a water dispenser when the water tank is installed on the water dispenser.

FIG. 1 shows a conventional sealing structure of a drinking water tank 10A. As shown, the water tank 10A is inversely disposed for being installed on a water dispenser 20A. The mouth of the tank 10A is covered with a cap 1A. Recessed from the center of the cap 1A is a hollow water guide 11A. A sealing cover 2A is disposed in the water guide 11A. Before the water tank 10A is installed in the water dispenser 20A, the cap 1A is sealed by the sealing cover 2A; and therefore, water in the tank 10A is prevented from flowing from the opening 12A through the water guide 11A. The sealing cover 2A also prevents objects entering the tank 10A to contaminate the water therein. As shown, the sealing cover 2A has a configuration conformal to the contour of the water guide 11A to provide the sealing function of the water tank 10A. When the water tank 20A is inversely installed on the water dispenser 10A, the sealing cover 3A is wide enough to accommodate the close end of a water inlet and venting pipe 3A of the water dispenser 20A therein. The sealing cover 2A has a latching structure 21A, such as a hook or a barb formed at a bottom edge of thereof, and the water inlet and venting pipe 3A includes a groove 31A along an exterior periphery thereof. Therefore, the sealing cover 2A can be engaged with the water inlet and venting pipe 3A when the water tank 20A is move downwardly.

As shown in FIGS. 2 and 3, when the water tank 10A is installed on the water dispenser 20A, the water guide 11A is aligned over the water inlet and venting pipe 3A, and the water tank 10A is downwardly to resulting in the engagement of the sealing cover 2A and the water inlet and venting pipe 3A. Relative to the downward movement of the water tank 10A, the sealing cover 2A engaged with the water inlet and venting pipe 3A is pushed upwardly until being removed from the water guide 11A of the cap 1A. Therefore, when the water tank 10A is installed on the water dispenser 20A, the sealing cover 2A and the water inlet venting pipe 3A are immersed in the water contained in the water tank 10A, such that water and air can flow into and from the water dispenser 20A through the water inlet and venting pipe 3A.

However, the above conventional sealing cover has the following drawbacks:

1. In the fabrication process, dimension error of the opening 12A of the water guide 11A or the sealing cover 2A is inevitable. Should error occurs between the sealing cover 2A and the water guide 22A, once the water tank 20A is inversed, water is leaking from the opening 12A between sealing cover 2A and the water guide 11A. The sealing effect is thus degraded.

2. The sealing cover 2A is engaged with the water inlet and venting pipe 3A by the latching structure 21A and the groove 31A only. Therefore, the engaging strength is insufficient. Therefore, the sealing cover 2A is easily detached from the water inlet and venting pipe 3A.

3. The sealing cover 2A is capped within the water guide 11A, such that the exterior sidewall of the sealing cover 2A is in contact with the sidewall of the water guide 11A. When the sealing cover 2A is pushed by the water inlet and venting pipe 3A to displace, the friction between the sealing cover 2A and the water guide affects the displacement.

BRIEF SUMMARY OF THE INVENTION

The present invention provides a sealing structure of a water tank to provide an improved sealing effect of the water tank.

The present invention further provides a sealing structure of a water tank that can be firmly engaged with the cap and the water tank and venting pipe when the water tank is installed on the water dispenser.

The present invention also provides a sealing structure of a water tank to improve the displacement when the water tank is installed on the water dispenser.

The present invention is characterized in forming a sealing structure of a water tank. The water tank has a mouth covered with a cap. The cap includes a top surface and a hollow guide recessed from the top surface to define an opening. A sealing cover having a bottom wall and a sidewall extending from the bottom wall is used to receive the hollow guide therein. The sealing cover includes a latching structure extending from the sidewall thereof to provide a friction contact with the hollow guide, such that the water tank is properly sealed before being installed on a water dispenser. The hollow guide also includes a latching structure at an edge distal to the top surface of the cap. Therefore, when the sealing cover stretches from the hollow guide, the latching structures latch with each other to prevent the sealing cover from being removed from the hollow guide. Preferably, the sidewall of the sealing cover includes at least water outlet aperture and an air inlet aperture thereon. When the hollow guide is received therein, the water outlet and air inlet apertures are blocked thereby.

The bottom wall of the sealing cover further comprises a recessed central portion and a latching structure such as an annular hook or an annular barb, formed on a top edge of the recessed central portion. Therefore, when the water tank is installed on the water dispenser which includes a water inlet and venting pipe, the sealing cover is engaged with the water inlet venting pipe by latching the latching structure thereof with a groove formed on the water inlet and venting pipe.

The present invention further provides a water tank comprising a tank for containing water therein, a cap for capping a mouth of the tank and having a top surface, a hollow water guide recessed from a central portion of the top surface, and a sealing cover. The hollow water guide defines an opening to allow water contained in the tank flowing through and includes a first latching structure at an edge distal to the top surface. The sealing cover encasing the hollow water guide includes a bottom surface covering the opening and a sidewall extending perpendicularly from the bottom wall. The sidewall further comprises a second attaching structure in frictional contact with the hollow water guide. The water tank is inversely disposed to be installed on a water dispenser which comprises a water inlet and venting pipe. The bottom wall of the sealing cover comprises a central recessed portion and a third latching structure along a top edge thereof, and the water inlet and venting pipe further comprises a groove formed on a periphery of a top portion thereof to engage with the third latching structure. The sidewall of the sealing cover further comprises at least one water outlet aperture and an air outlet aperture.

The present invention further provides a water dispenser system comprising a water dispenser and a water tank. The water dispenser includes a water inlet and venting pipe which has at least one water inlet aperture and a venting aperture formed thereon. The water tank is to be installed on the water dispenser and comprises a tank for containing water therein, a cap capping a mouth of the tank, a hollow water guide and a sealing cover. The cap has a top surface, and the hollow guide is recessed from the central portion to define an opening through which water and air can be communicated between the water tank and the water dispenser. The hollow water guide has a first latching structure at an edge distal to the top surface. The sealing cover encases the hollow water guide therein and has a bottom surface covering the opening and a sidewall extending perpendicularly from the bottom wall. The sidewall further comprising a second attaching structure in frictional contact with the hollow water guide.

In one embodiment, the water tank is inversely disposed to be installed on a water dispenser which comprises a water inlet and venting pipe aligned with the water inlet aperture and the venting aperture, respectively, when the water tank is installed on the water dispenser. The bottom wall of the sealing cover comprises a central recessed portion and a third latching structure along a top edge thereof, and the water inlet and venting pipe further comprises a groove formed on a periphery of a top portion thereof to engage with the third latching structure when the water tank is installed on the water dispenser.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
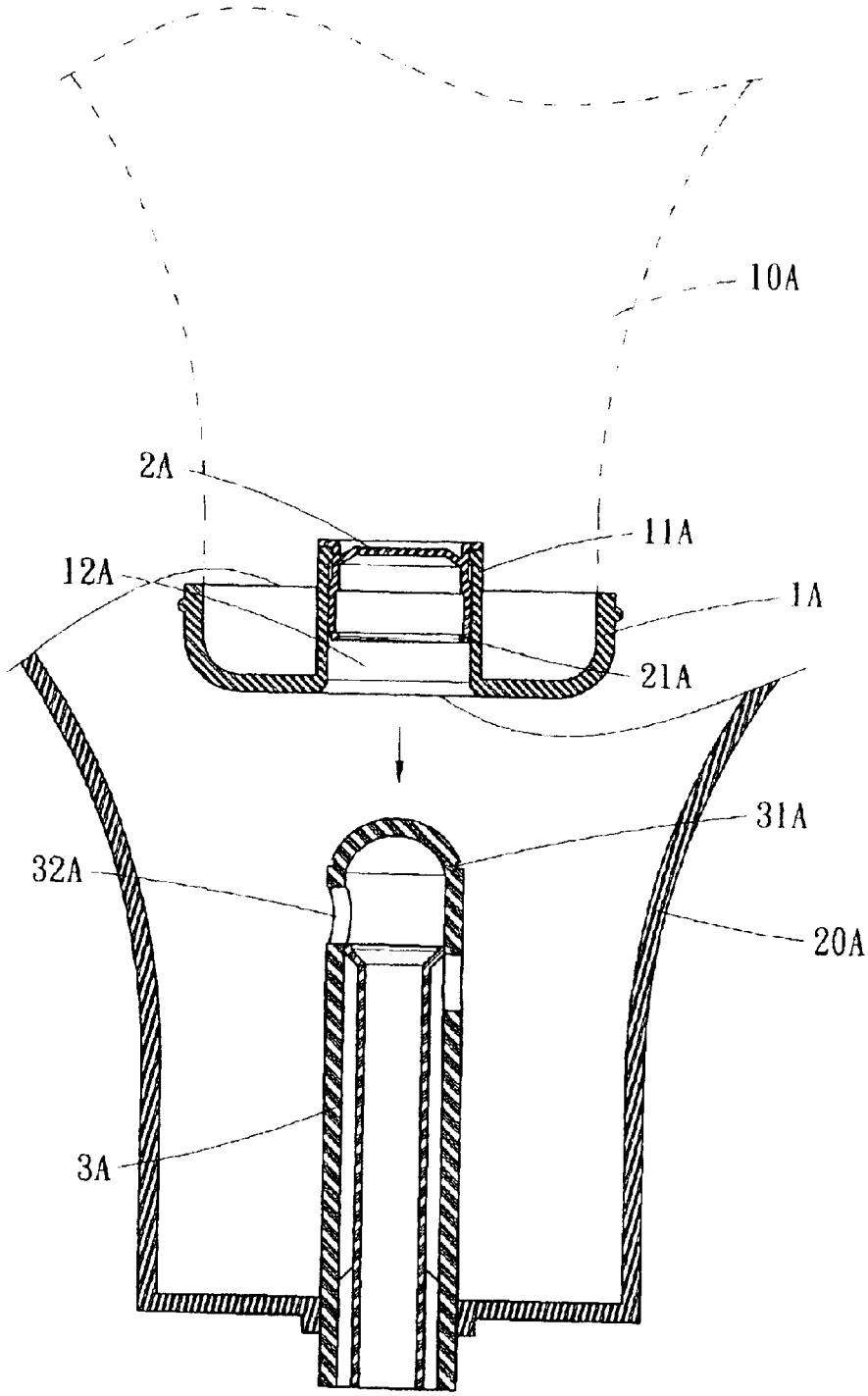
FIG. 1 PRIOR ART
FIG. 1 shows an exploded view of a conventional water tank to be installed on a water dispenser.
Figure 2:
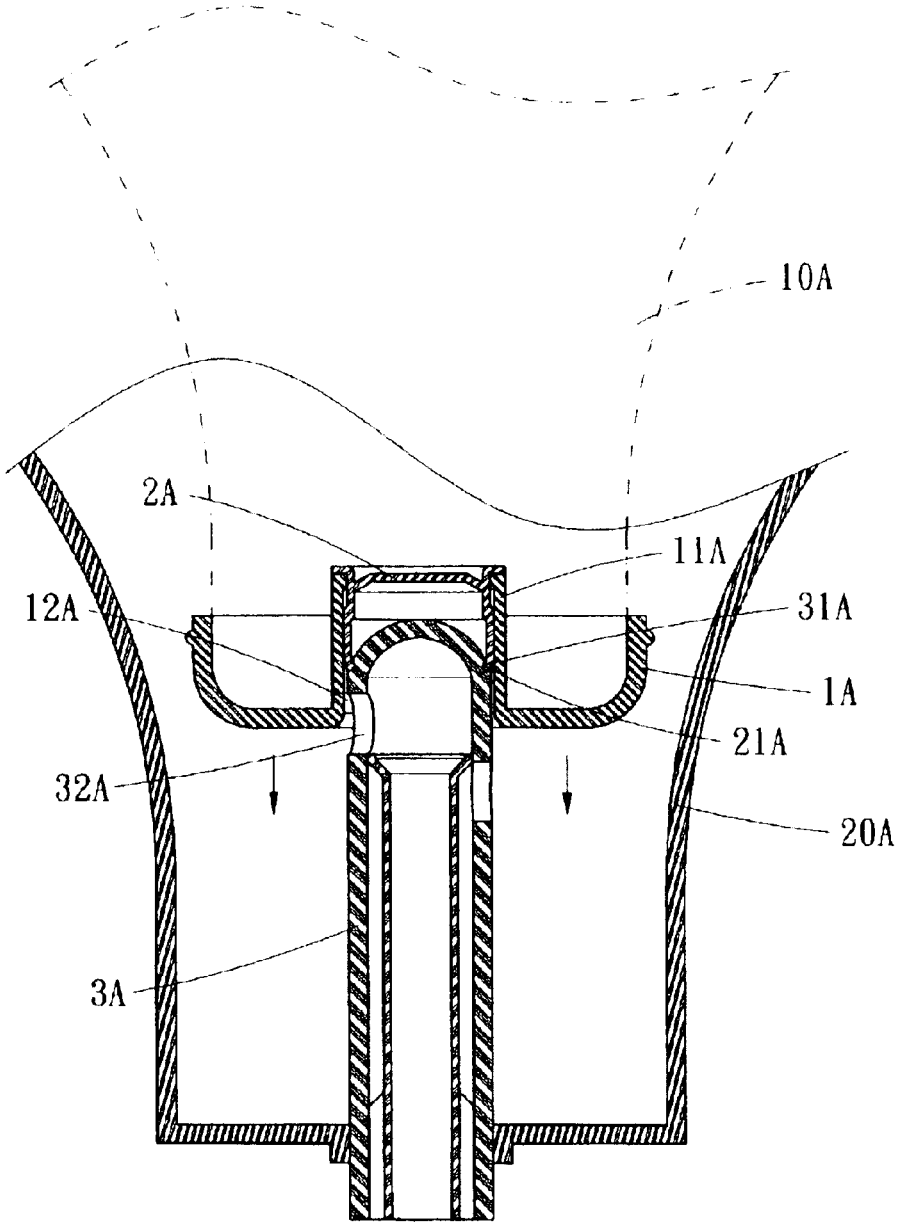
FIG. 2 PRIOR ART
FIG. 2 is shows the beginning of installation of the water tank on the water dispenser as illustrated in FIG. 1.
Figure 3:
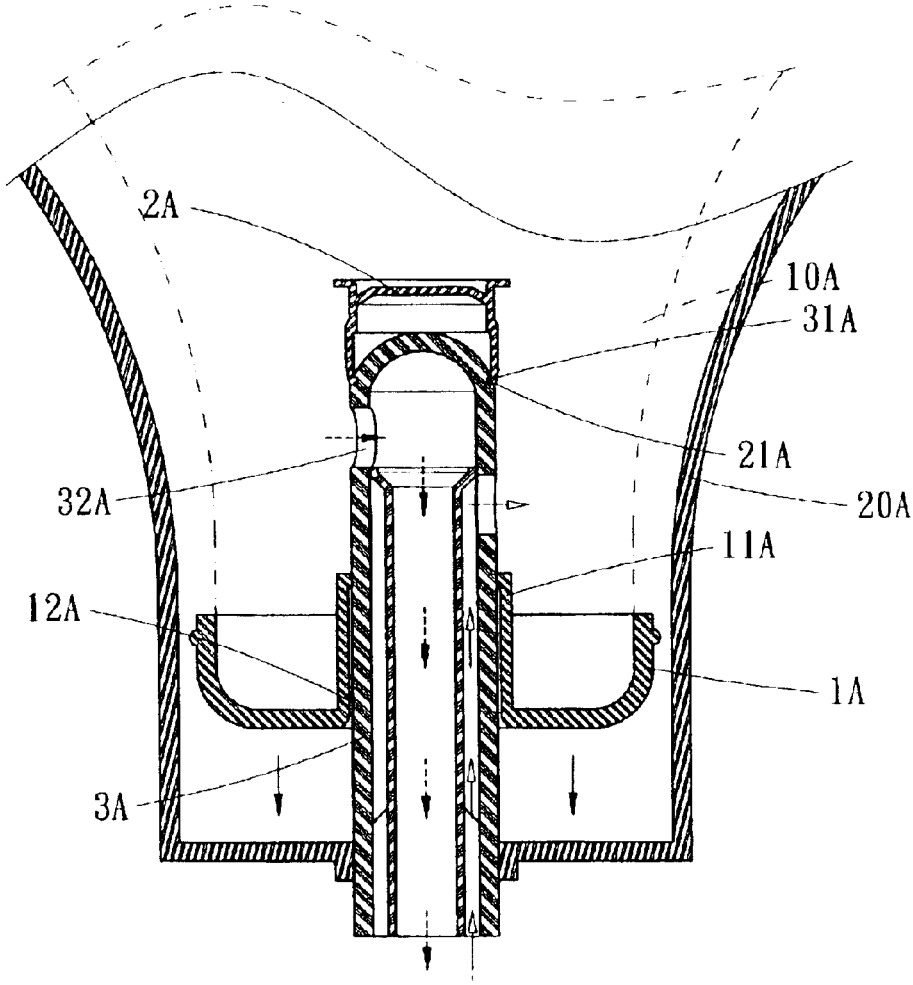
FIG. 3 PRIOR ART
FIG. 3 shows the water tank that has been installed on the water dispenser.
Figure 4:
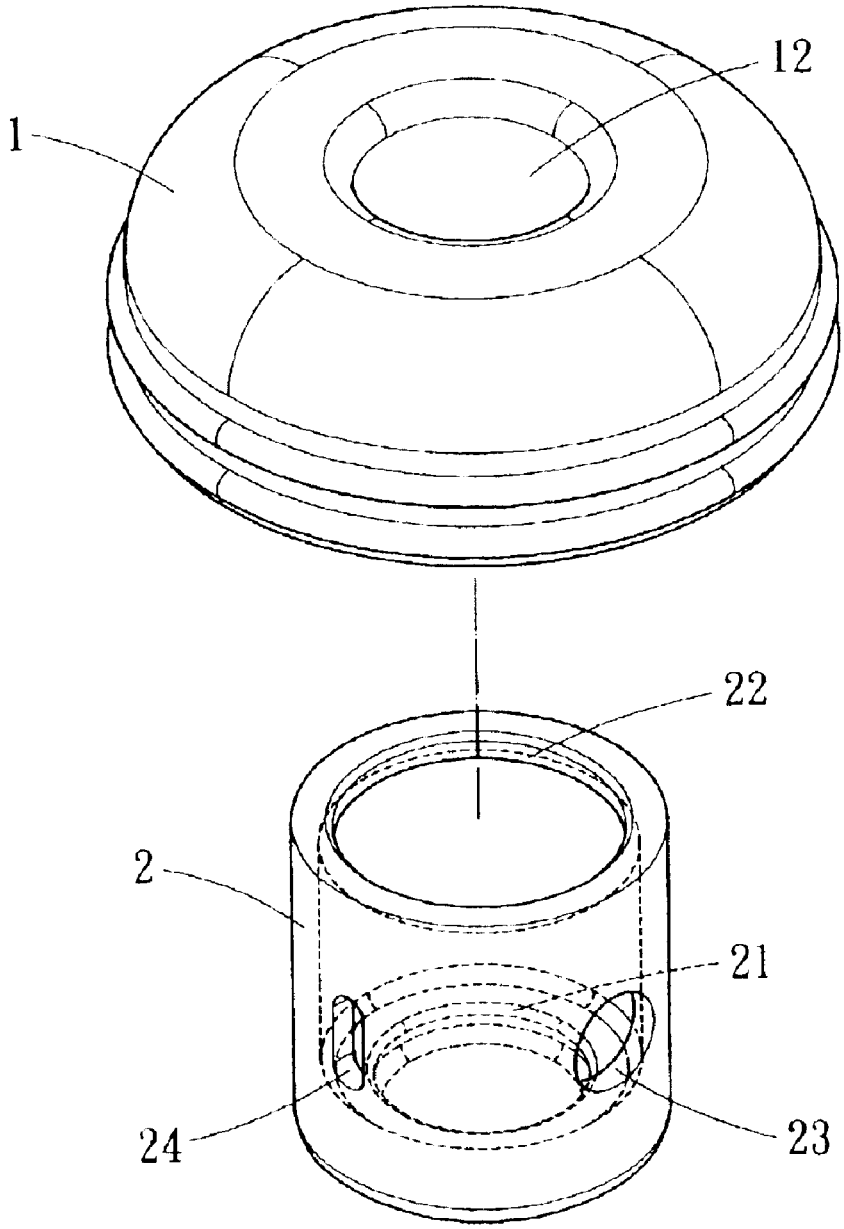
FIG. 4 shows a perspective view of a cap and a sealing cover of a water tank provided by the present invention.
Figure 5:
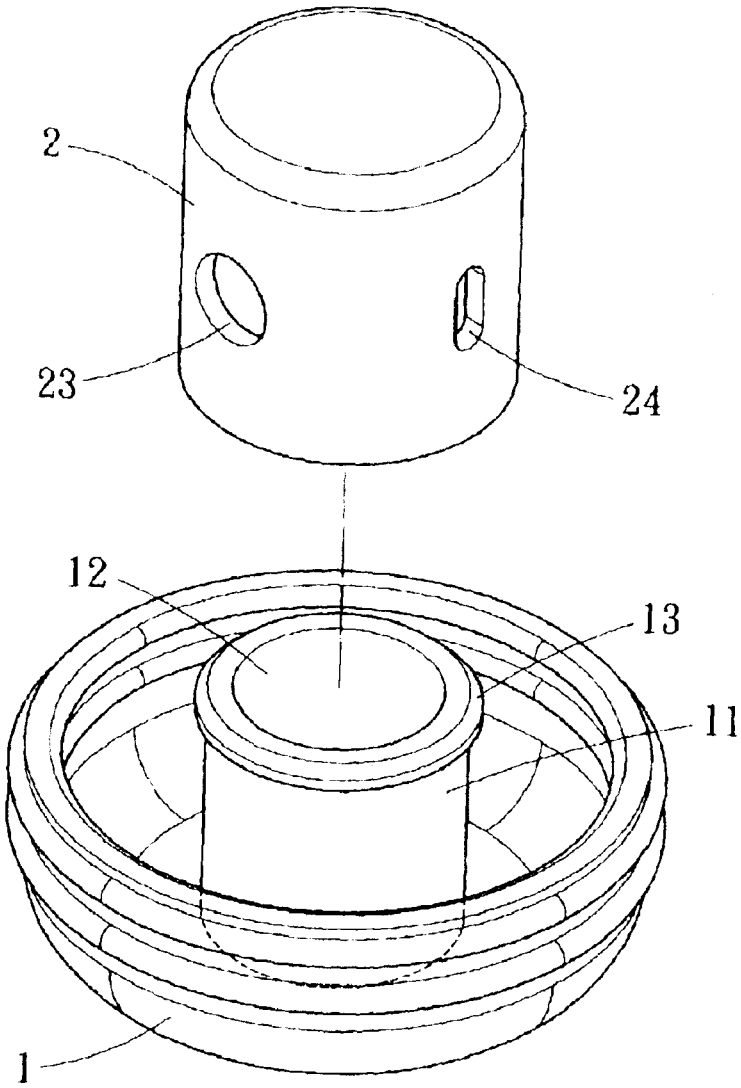
FIG. 5 shows the cap and the sealing cover as illustrated in FIG. 4 from another viewing angle.
Figure 7:
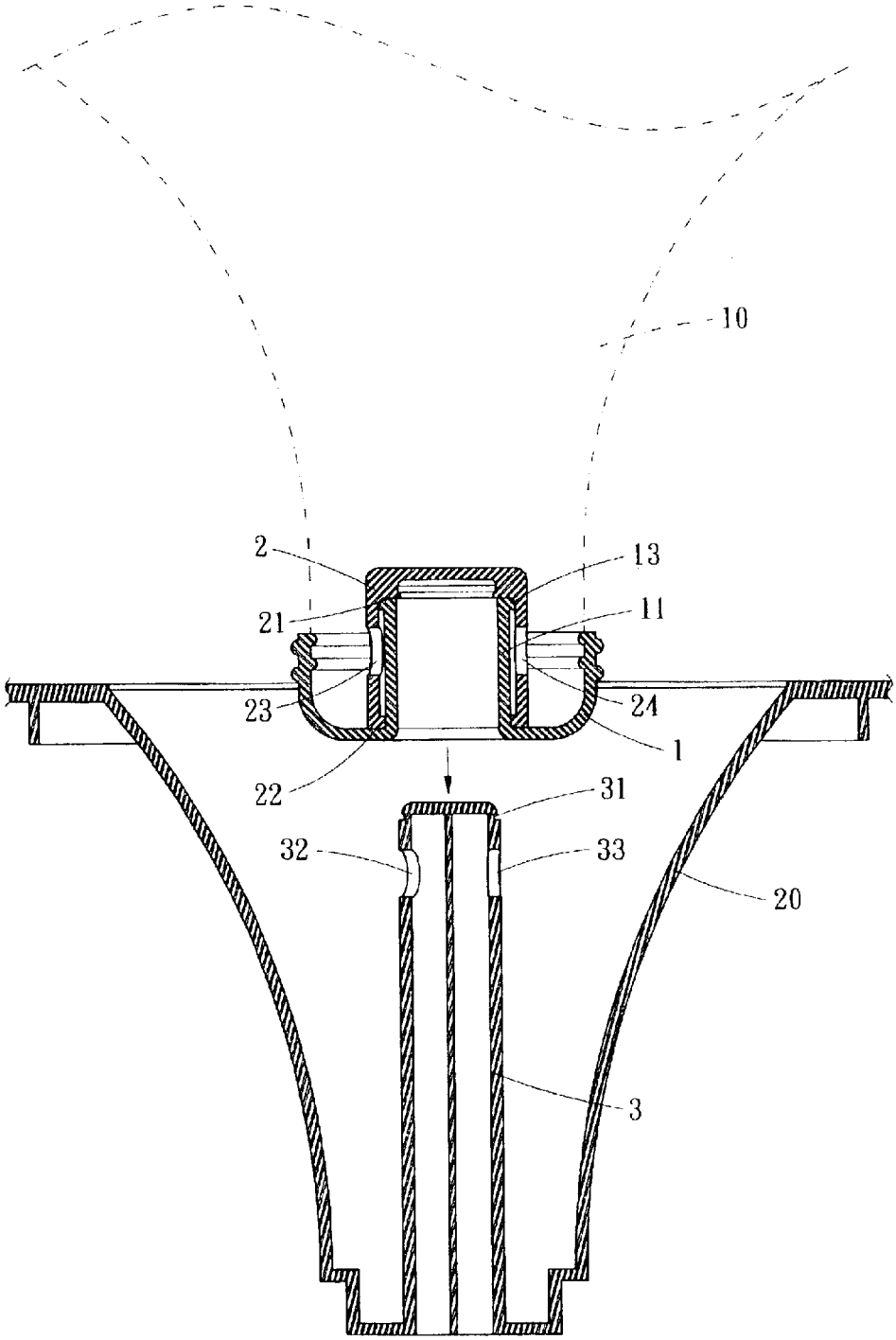
FIG. 7 shows a water tank provided by the present invention to be installed on a water dispenser.

The present invention provides a sealing structure of a drinking water tank. Referring to FIGS. 4, 5 and 7, the water tank 10 is to be installed on a water dispenser 20. Water contained in the water tank 10. The water tank 10 includes a cap 1 mounted to a mouth thereof. The cap 1 includes a hollow water guide 11 recessed from a center thereof allowing the water contained in the water tank 10 to flow through. Before the water tank 10 is installed on the water dispenser 20, the cap 1 is sealed by a sealing cover 2 which telescopically receives the water guide 11 therein. To install the water tank 10 on the water dispenser 20, the water tank 10 is inversed with the water guide 11 aligned over the water inlet and venting pipe 3, and push downwardly. The sealing cover 2 is then pushed by the water inlet and venting pipe 3 to cause an upward displacement of the water guide 11. Consequently, the opening 12 of the cap 1 is open to allow water flowing from the water tank 10 to the water dispenser 20.

In the present invention, the sealing cover 2 is preferably conformal to the contour of the water guide 11. The sealing cover 2 has a bottom wall and a sidewall extending perpendicular from the bottom wall. When the water guide 11 has a cylindrical contour, the sealing cover 2 is in the form of a cylinder with one end closed with the bottom wall and the other end open. As shown, the bottom wall of the sealing cover 2 includes a central recessed portion. Along a periphery of the central recessed portion, a latching structure 21 is formed. The top portion of the water inlet and venting pipe 3 of the water dispenser 20 is about the same size of the central recessed portion of the sealing cover. Along a periphery of the top portion of the water inlet and venting pipe 3, a groove 31 is formed. Therefore, while installing the water tank 10 on the water dispenser 20, the water tank 10 is moved downwardly to bring the bottom wall of the sealing cover 2 in contact with the top portion of the water inlet and venting pipe 3, and the sealing cover 2 is engaged with the water inlet and venting pipe 3 by latching the latching structure 21 with the groove 31. As mentioned above, the sealing cover 2 is telescopically engaged with the water guide 11; and therefore, a further downward movement allows the sealing cover 2 to stretch from the water guide 11. To avoid the sealing cover 2 detached from the water guide 11 and the cap 2, the edge of the sidewall of the sealing cover 2 further comprises a latching structure 22, and the edge of the water guide 11 has a latching structure 13. Therefore, when the sealing cover 2 is stretching from water guide 11, the latching structures 22 of the sealing cover 2 and the latching structure 13 of the water guide 11 are latched with each other, such that the whole cap 2 is driven by the sealing cover 2 and removed from the mouth of the water tank 20.

Referring to FIG. 7, the sealing cover 2 further comprises at least one water outlet aperture 23 and an air inlet aperture 24, such that when the sealing cover 2 is engaged with the top portion of the water inlet and venting pipe 3 and push upwardly, the water outlet aperture 23 and the air inlet aperture 24 are aligned with the water inlet aperture 32 and the venting aperture 33 formed on the water inlet and venting pipe 3, respectively.

Figure 6:
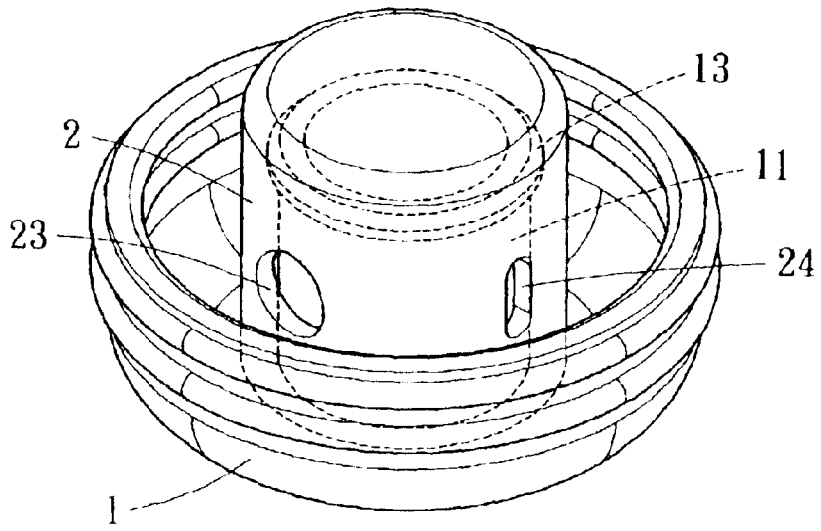
FIG. 6 shows the sealing cover capped within the cap.

In contrast, when the water guide 11 is received in the sealing cover 2 and before the sealing cover 2 is pushed upwardly by the water inlet and venting pipe 3, as shown in FIG. 6, the water outlet aperture 23 and the air inlet aperture 24 are blocked by the water guide 11. Therefore, water is prevented from flowing into the water dispenser 20, and air cannot be vented into the water tank 10. Further, the latching structure 22 at the edge of the sidewall of the sealing cover 2 provide a friction contact between the sealing cover 2 and the water guide 10, such that the water tank 10 is properly sealed.

Figure 8:
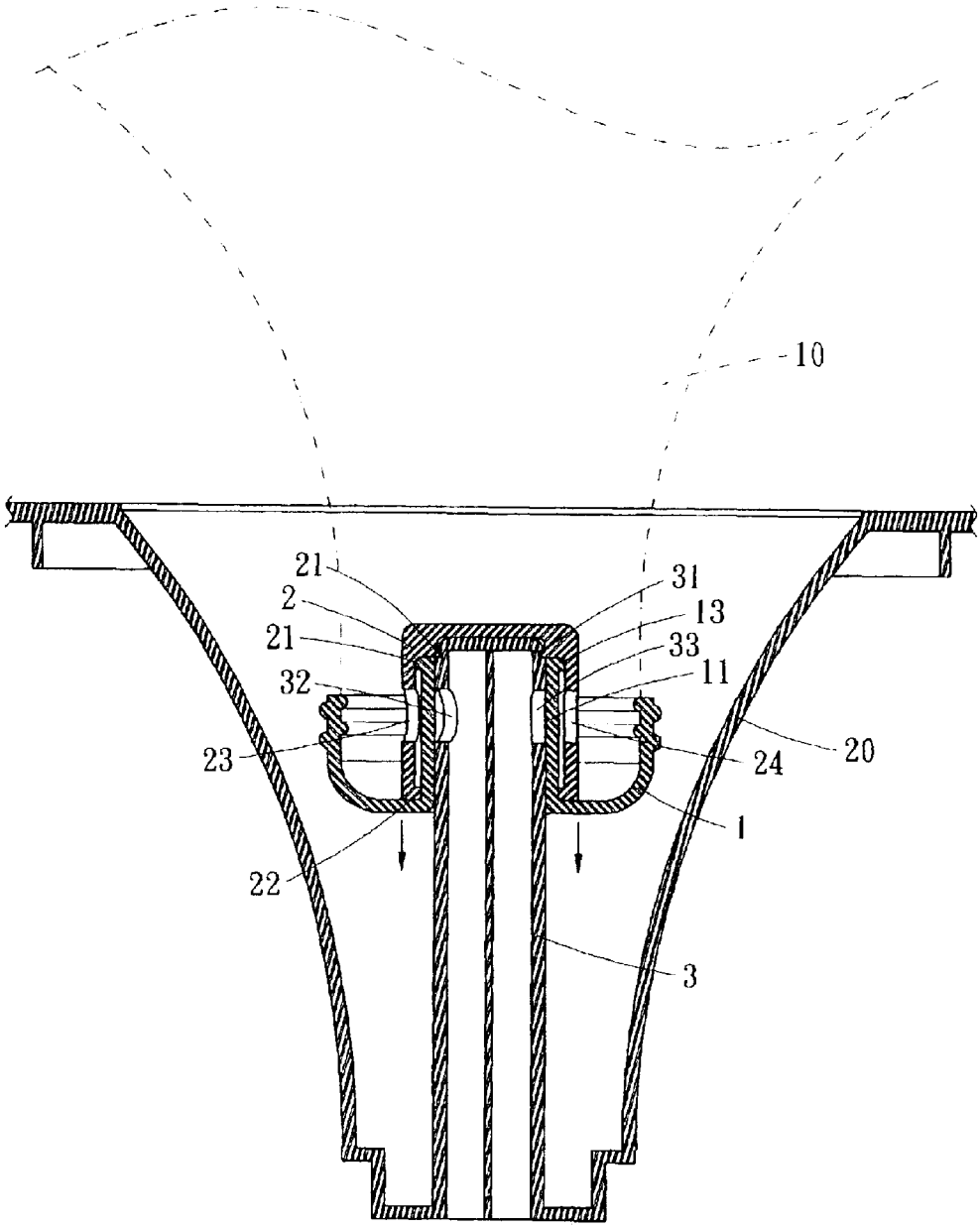
FIG. 8 shows the beginning of installing the water tank as illustrated in FIG. 7 on a water dispenser.

As shown in FIG. 7, to install the water tank 10 on the water dispenser 20, the water tank 10 is inversely disposed with the opening 12 of the water guide 11 aligned over the water inlet and venting pipe 3. As shown in FIG. 8, when the water inlet and venting pipe 3 is inserted into the opening 12 to bring the top portion thereof in contact with the bottom wall of the sealing cover 2, the latching structure 21 is locked with the groove 31, such that the sealing cover 2 is engaged with the water inlet and venting pipe 3. Meanwhile, as the sealing cover 2 is not displaced yet, so that water contained in the water tank 10 is still prevented from flowing into the water dispenser 10.

Figure 9:
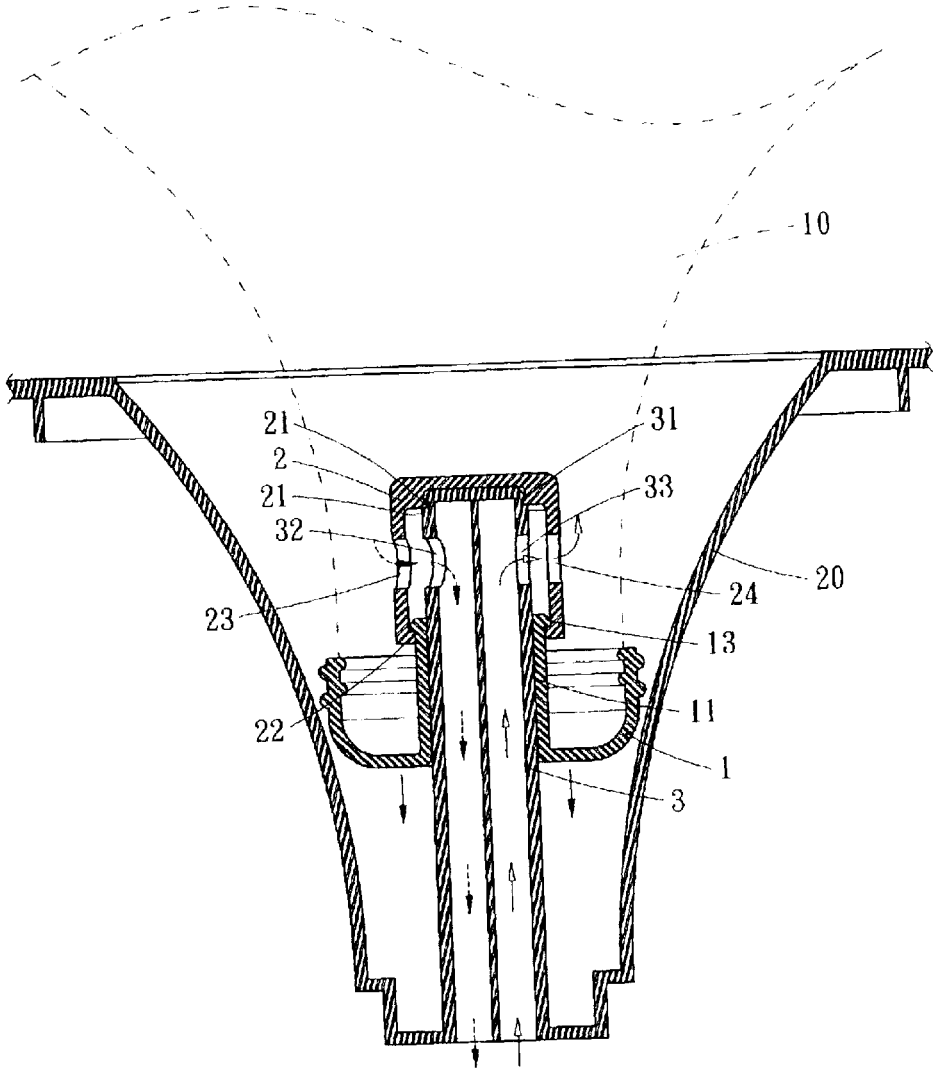
FIG. 9 shows the water tank installed on the water dispenser.

Referring to FIG. 9, by further moving the water tank 10 downwardly, relative to the water tank 10, the sealing cover 2 engaged with the water inlet and venting pipe 3 is pushed upwardly to stretch from the water guide 11. Therefore, the water outlet aperture 23 and the air inlet aperture 24 are unblocked to provide the channel for water flowing into the water dispenser 20, and air venting to the water tank 10. However, when the sealing cover 2 fully stretches from the water guide 11, the latching structures 22 and 13 are latched with each other to engage the sealing cover 2 with the water guide 11. Preferably, the water outlet aperture 23 is aligned with the water inlet aperture 32, while the air inlet aperture 24 is aligned with the venting aperture 33. Therefore, water can flow from the water tank 10 to the water dispenser 20, and air can be vented into the water tank 10.

According to the above, the present invention provides at least the following advantages:

1. As the water guide 11 is telescopically received within the sealing cover 2 and the top edge of water guide 11 provides a friction contact there between, when the water tank 10 is inversed, the gravitation of the water presses the sealing cover 2 towards the water guide 11, and further enhances the sealing effect.

2. The sealing cover 2 has two latching structures 21 and 22 to latch with the water inlet and venting pipe 3 and the water guide 11. The pair of latching structures thus ensures the engagement between the water guide 11 and the water inlet and venting pipe 3 during the relative displacement of the sealing cover 2.

3. During the displacement of the sealing cover 2, the latching structure 22 provides a linear friction contact between the water guide 11 and the sealing cover 2, such that the displacement is more fluent.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A sealing structure for sealing a water tank to be installed on a water dispenser, comprising:

a cap mounted to a mouth of the water tank, the cap comprising a hollow water guide recessed from a top surface thereof, the water guide includes a first latching structure on an edge distal to the top surface; and a sealing cover, telescopically receiving the water guide therein, wherein the sealing cover includes a bottom wall and a sidewall extending from the bottom wall, the sidewall includes a water outlet aperture, an air inlet aperture, and a second latching structure along an edge thereof, and the bottom wall includes a central recessed portion, and a third latching structure formed along an edge of the central recessed portion.

2. The sealing structure of claim 1, wherein the water dispenser includes a water inlet and venting pipe having a groove formed along a periphery of a top portion thereof.

3. The sealing structure of claim 2, wherein the third latching structure is latched with the groove when the water tank is installed on the water dispenser.

4. The sealing structure of claim 1, wherein the first latching structure is latched with the second structure when the sealing cover stretches from the water guide.

5. A water tank, comprising:

a tank for containing water therein;

a cap capping a mouth of the tank and having a top surface;

a hollow water guide recessed from a central portion of the top surface, the hollow water guide defining an opening and having a first latching structure at an edge distal to the top surface; and a sealing cover, encasing the hollow water guide therein, the sealing cover having a bottom surface covering the opening and a sidewall extending perpendicularly from the bottom wall, wherein the sidewall further comprising a second attaching structure in frictional contact with the hollow water guide.

6. The water tank of claim 5, wherein the water tank is inversely disposed to be installed on a water dispenser which comprises a water inlet and venting pipe.

7. The water tank of claim 6, wherein the bottom wall of the sealing cover comprises a central recessed portion and a third latching structure along a top edge thereof, and the water inlet and venting pipe further comprises a groove formed on a periphery of a top portion thereof to engage with the third latching structure.

8. The water tank of claim 5, wherein the sidewall of the sealing cover further comprising at least one water outlet aperture and an air outlet aperture.

9. A water dispenser system, comprising:

a water dispenser, including a water inlet and venting pipe therein and at least one water inlet aperture and a venting aperture formed on the water inlet and venting pipe;

a water tank to be installed on the water dispenser, the water tank further comprising:

a tank for containing water therein;

a cap capping a mouth of the tank and having a top surface;

a hollow water guide recessed from a central portion of the top surface, the hollow water guide defining an opening and having a first latching structure at an edge distal to the top surface; and a sealing cover, encasing the hollow water guide therein, the sealing cover having a bottom surface covering the opening and a sidewall extending perpendicularly from the bottom wall, wherein the sidewall further comprising a second attaching structure in frictional contact with the hollow water guide.

10. The water tank of claim 9, wherein the water tank is inversely disposed to be installed on a water dispenser which comprises a water inlet and venting pipe aligned with the water inlet aperture and the venting aperture, respectively, when the water tank is installed on the water dispenser.

11. The water tank of claim 9, wherein the bottom wall of the sealing cover comprises a central recessed portion and a third latching structure along a top edge thereof, and the water inlet and venting pipe further comprises a groove formed on a periphery of a top portion thereof to engage with the third latching structure when the water tank is installed on the water dispenser.

* * * * *